US009938048B2

(12) United States Patent
Kropf

(10) Patent No.: US 9,938,048 B2
(45) Date of Patent: Apr. 10, 2018

(54) CONTAINER CLOSURE

(71) Applicant: CELLPACK AG, Villmergen (CH)

(72) Inventor: Martin Kropf, Münchenbuchsee (CH)

(73) Assignee: CELLPACK AG (CH)

( * ) Notice: Subject to any disclaimer, the term of this patent is extended or adjusted under 35 U.S.C. 154(b) by 0 days.

(21) Appl. No.: 15/111,437

(22) PCT Filed: Jan. 30, 2015

(86) PCT No.: PCT/EP2015/051912

§ 371 (c)(1),
(2) Date: Jul. 13, 2016

(87) PCT Pub. No.: WO2015/114084

PCT Pub. Date: Aug. 6, 2015

(65) Prior Publication Data

US 2016/0340087 A1 Nov. 24, 2016

(30) Foreign Application Priority Data

Feb. 3, 2014 (EP) ..... 14153668

(51) Int. Cl.
*B67D 1/00* (2006.01)
*B65D 41/04* (2006.01)
(Continued)

(52) U.S. Cl.
CPC ..... *B65D 41/0471* (2013.01); *B65D 41/0485* (2013.01); *B65D 47/106* (2013.01); *B65D 55/024* (2013.01); *B65D 75/5883* (2013.01)

(58) Field of Classification Search
CPC ..... B65D 41/0471; B65D 41/0485; B65D 47/106; B65D 75/5883; B65D 55/204
(Continued)

(56) References Cited

U.S. PATENT DOCUMENTS 7,942,287 B2 * 5/2011 King ..... B65D 41/0421 215/307
8,443,999 B1 5/2013 Reinders ..... 220/303
(Continued)

FOREIGN PATENT DOCUMENTS

EP 2 253 555 B1 11/2010
EP 2653404 A1 10/2013
(Continued)

OTHER PUBLICATIONS

International Search Report dated Apr. 10, 2015 issued in corresponding International Patent Application No. PCT/EP2015/051912.

*Primary Examiner* — Lien Ngo
(74) *Attorney, Agent, or Firm* — Ostrolenk Faber LLP

(57) ABSTRACT

The container closure (1) consists of a spout (2) intended to be connected to a container and of a cap (3) that closes the spout. The latter is provided with two wings (6). From a sealing closed position, the cap (3) is movable by a twisting movement of less than 180 degrees to a released position in which it can be withdrawn from the spout (2). Stop means arranged on the spout (2) and on the cap (3) define the closed position. In addition, a locking member (11) may be provided in the cap (3) which only allows opening the latter after the rupture of a predetermined breaking point (18).

7 Claims, 3 Drawing Sheets

(51) Int. Cl.
*B65D 75/58* (2006.01)
*B65D 55/02* (2006.01)
*B65D 47/10* (2006.01)

(58) Field of Classification Search
USPC ..... 222/153.14, 206, 22, 106, 107, 215; 383/5, 42, 80; 220/293, 296; 215/330, 215/332, 305
See application file for complete search history.

(56) References Cited

U.S. PATENT DOCUMENTS

| | | | | |
|---|---|---|---|---|
| 2004/0238564 | A1 | 12/2004 | Bourque et al. | |
| 2009/0223963 | A1* | 9/2009 | Bisio ..... | B65D 41/3404 220/304 |
| 2014/0010481 | A1* | 1/2014 | Last ..... | B65D 75/5883 383/5 |
| 2016/0145025 | A1* | 5/2016 | Van Der Molen . | B65D 75/5883 222/107 |

FOREIGN PATENT DOCUMENTS

| | | | |
|---|---|---|---|
| FR | 2 609 970 | A1 | 7/1988 |
| GB | 653 884 | | 5/1951 |
| WO | WO 2013/053651 | A1 | 4/2013 |

* cited by examiner

CONTAINER CLOSURE

CROSS REFERENCE TO RELATED APPLICATIONS

The present application is a 35 U.S.C. § 371 National Phase conversion of PCT/EP2015/051912, filed Jan. 30, 2015, which claims the benefit of European patent application no. 14153668.0, filed Feb. 3, 2014, the disclosures of which are incorporated herein by reference. The PCT International Application was published in the English language.

TECHNICAL FIELD OF THE INVENTION

The invention relates to a container closure according to the preamble of claim 1.

BACKGROUND OF THE INVENTION

Known container closures have a screw cap that is generally provided with a tamper-evident tear-off ring. The screw cap allows reclosing the container after first time opening. However, the known screw caps have the disadvantage that they can be swallowed, particularly by children. Therefore, measures have been sought to exclude this dangerous swallowing risk. The reference EP2653404A1 shows a known solution where the cap is simply enlarged. A disadvantage of this solution is the substantially higher material consumption for the manufacture of the cap, in particular. Another problem that may arise, however, is the torque applied when the cap is reclosed which, due to the enlarged diameter, is much higher than in the known small screw caps and may cause the thread to be destroyed. Another disadvantage of this solution is that the tamper-evident seal formed by an axially removable tear-off ring under the edge of the cap is partly hidden and thus not visible at first sight.

Another solution to the problem of the swallowing risk is described in the reference US2004/238564A1. The described cap is provided with two lateral wing-like blades which prevent swallowing. The cap is integrally connected to a tubular spout and is separated therefrom by being twisted or broken off along a weakening line. To be reclosed, the cap is inverted and a lid portion integrated therein is pushed over the spout. In alternative solutions, a plug that is pushed into the opening at the end of the spout is provided instead of a lid. Both solutions are disadvantageous for hygienic reasons as the mentioned opening or plug, respectively, is exposed to the surroundings and thus to impurities before first-time opening.

Other solutions such as the one described in the reference EP2253555B1 combine a screw cap with wing-like enlargements. These entail the disadvantage that the orientation of the wings is rather coincidental when the screw closure is tightened and thus sealing. For automatically processing pouches where the spout is welded in between sheets in a defined position, however, it is indispensable that the wings are always aligned in parallel to the empty pouch so that they will not occupy too much space in the corresponding magazines or cause disturbances during the transport of the pouches.

On the background of this prior art it is the object of the invention to suggest a container closure where the cap has a defined rotational position relative to the spout in the closed condition.

SUMMARY OF THE INVENTION

According to the invention, this object is achieved by the features specified in the characterising part of claim 1.

In particular, this inventive solution offers the advantage that due to the relatively short twisting movement that is required for opening and closing, a single closed position as well as a released position that varies within a relatively small range are possible and clearly recognisable, and that the stop means ensure a clearly defined closed position.

Particular embodiments of the invention are defined in the dependent claims.

BRIEF DESCRIPTION OF THE DRAWINGS

Exemplary embodiments of the invention will be described by way of examples hereinafter with reference to the accompanying drawings showing FIG. 1 an elevation of the container closure in the closed condition.

DESCRIPTION OF EMBODIMENTS

Figure 1:
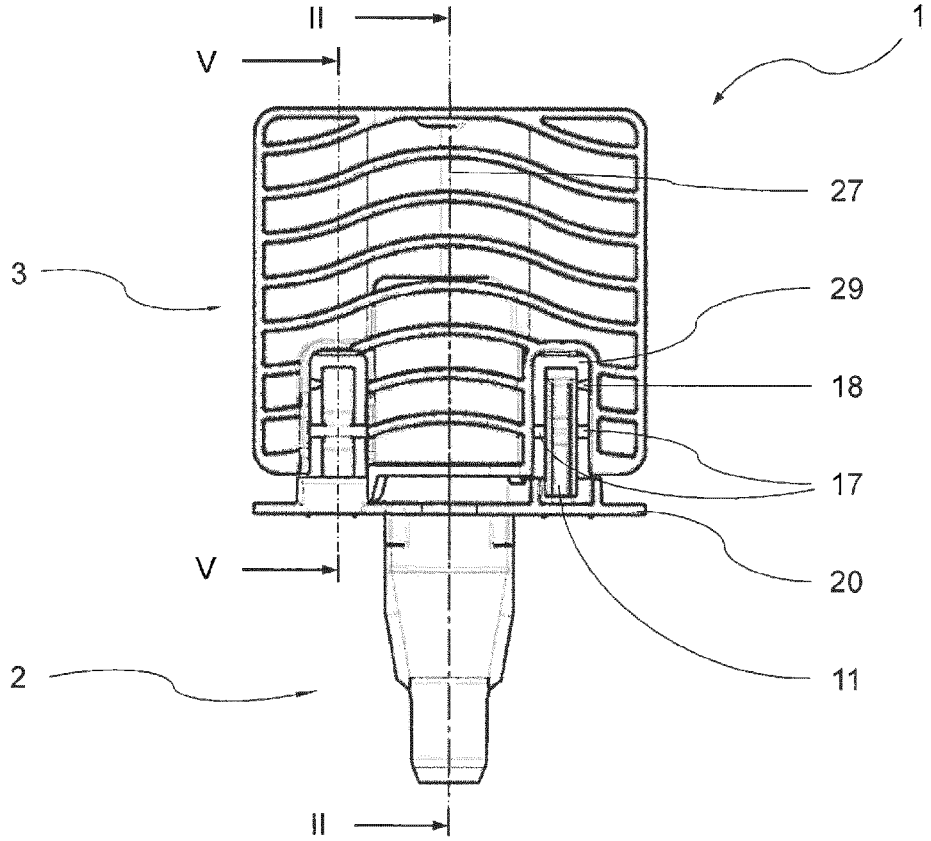
Figure 2:
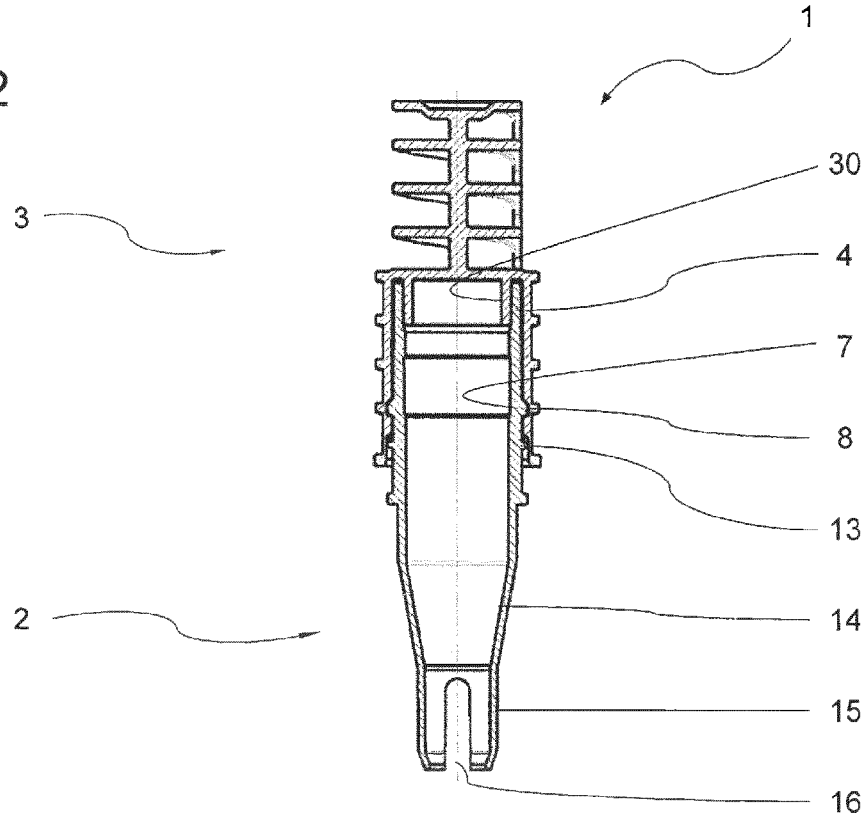
FIG. 2 a vertical section along line II-II in FIG. 1.
Figure 4:
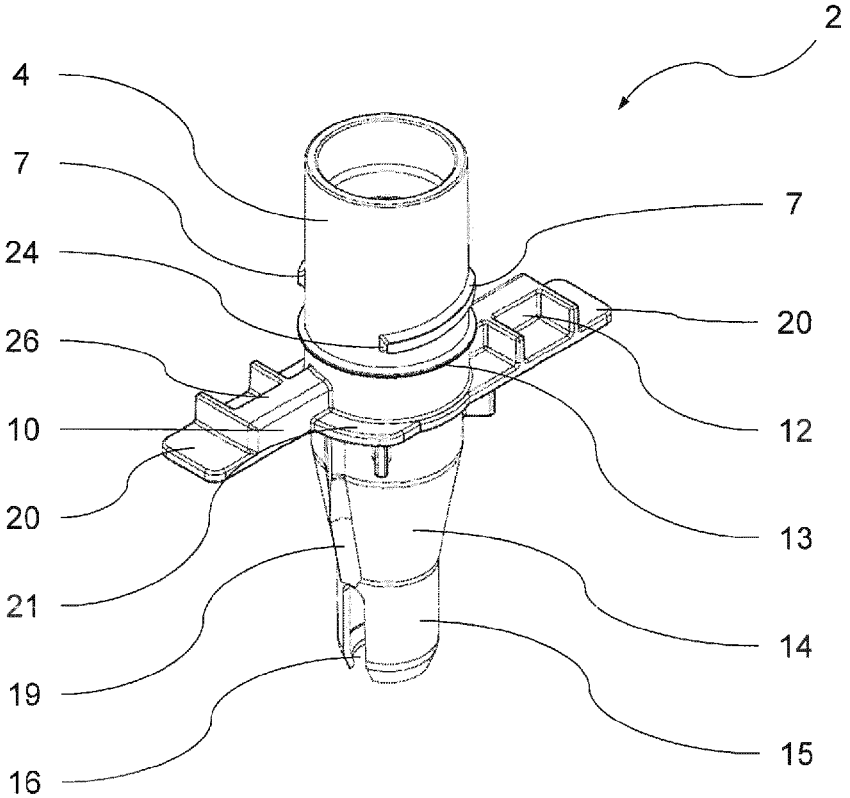
FIG. 4 a perspective view of the spout.
Figure 5:
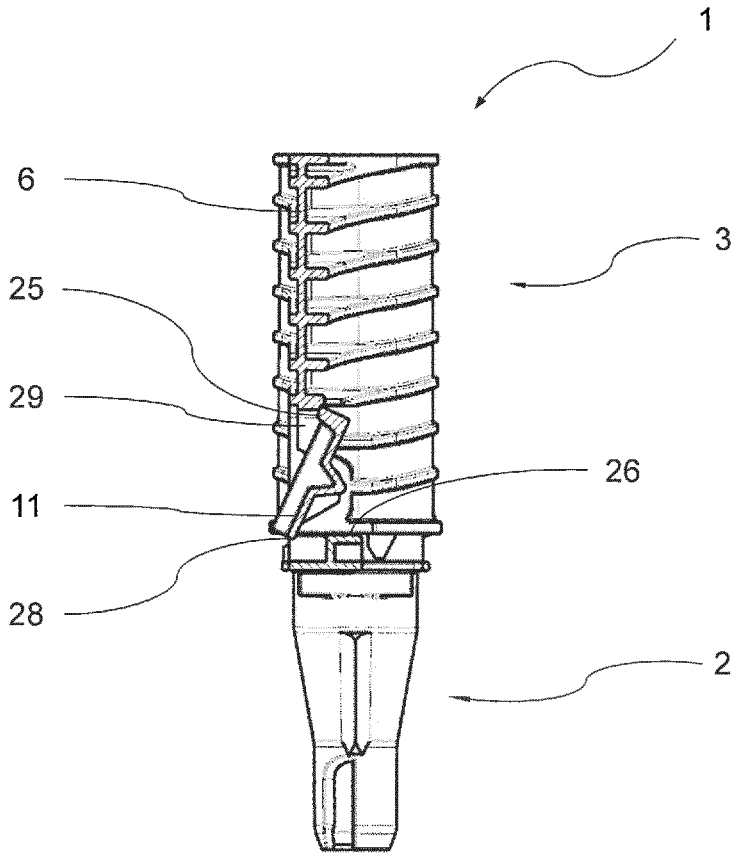
FIG. 5 a section along line V-V in FIG. 1 after first-time opening.

The container closure that is globally denoted by 1 in FIGS. 1, 2, and 5 is composed of a spout 2 and a cap 3 that is removably retained thereon. Spout 2 is intended to be connected to a non-represented container in order to allow to subsequently dispense the content of the container. It is understood that spout 2 can also be used for filling the container. In the depicted example, spout 2 is designed for being welded in between two film layers of a flexible container that is intended to receive in particular a liquid or pasty product. More specifically, a connecting region 14 (FIGS. 2 and 4) is provided for its connection to the sheets which in a known manner may comprise two lateral fins 19 (FIG. 4) in order to improve the connection to the sheets in the area of the transition between spout 2 and the interconnected film layers. An optional neck 15 may be provided at the free end of connecting region 14 and may have at least one slot 16 that is to facilitate the extraction of a liquid content.

As seen in FIG. 4, spout 2 is provided with a tubular appendage 4 destined for dispensing a liquid or pasty container content or directly for drinking. The open end of tubular appendage 4 located at the top in FIG. 4 can be closed by means of the mentioned cap 3. The seal between appendage 4 and cap 3 is ensured by a sealing neck 30 lying against the inner wall of appendage 4 and/or by a portion of the inner wall of cap 3 and is expressly not achieved between the front surface of appendage 4 and the bottom of cap 3. A circumferential rib 13 increases the stiffness of appendage 4 and together with the inner wall of cap 3 provides an additional sealing effect when container closure 1 is closed, thereby protecting the portion of tubular appendage 4 that may subsequently enter into contact with one's mouth from impurities and humidity. Below rib 13 a support member 20 is arranged which includes various elements that will be discussed below in connection with the description of the cooperation of spout 2 and cap 3. An engagement means 7 having the form of a section of an external thread in the present example will also be described in more detail hereinafter.

Figure 3:
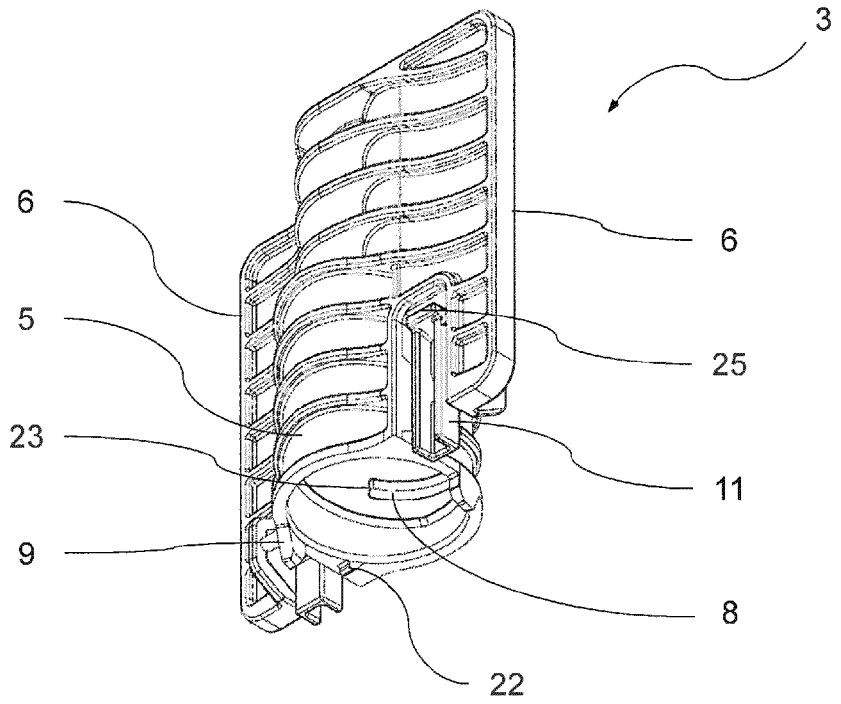
FIG. 3 a perspective view of the cap.

Cap 3 shown in perspective in FIG. 3 is provided with two wings 6 which facilitate the rotation of cap 3 by hand. Wings 6 project from a sleeve-shaped portion 5 radially or tangentially. The term tangential means that a centre plane of wings 6 may be offset from the centre plane in which the centre axis 27 of cap 3 is situated. In the inner wall of sleeve-shaped portion 5, another engagement means 8 is visible, here in the form of a section of an internal thread. According to the invention, engagement means 7 and 8 are so designed that the angle of rotation from the closed position to the released position is smaller than 180 degrees. In the depicted embodiment this is achieved in that engagement means 7 respectively 8 in the form of thread sections only extend over about a quarter of the circumference of tubular appendage 4 and of sleeve-shaped portion 5, respectively. To allow an effortless axial withdrawal of cap 3 in its released position, a disengagement area that follows area 8 and extends up to the open end of cap 3 but is not visible in the drawings is formed in the cap and allows an unhindered passage of the engagement means 7. The profile of the aforementioned thread sections is advantageously designed in such a manner that cap 3, when initially mounted, can be pushed onto spout 2 axially without a twisting movement while engagement means 7 and 8 snap over each other and thus enter into engagement. This is e.g. achieved by a serrated profile or a semi-circular profile of the thread sections. This offers the advantage that forced demoulding can be applied in the production of spout 2 and of cap 3 from a synthetic material by injection moulding and that no sliding devices for the engagement means 7, 8 have to be provided in the injection moulding tool. Furthermore, engagement means 7 and 8 are preferably arranged in respective pairs opposite each other, as suggested by reference numeral 7 on the left in FIG. 4. Also it is advantageous if engagement means 7 are arranged at a distance from the free end of tubular appendage 4, as appears clearly in FIG. 4. This is advantageous in that the lips of a person who is drinking from spout 2 are in contact with a smooth surface without salient elements.

Instead of being designed as thread sections, engagement means 7, 8 may alternatively be in the form of bayonet couplings, e.g. according to a non-represented embodiment where a radially projecting pin is formed on the exterior of tubular projection 4 and a corresponding groove in the interior of sleeve-shaped portion 5.

To ensure that cap 3 also takes a defined position relative to spout 2 when reclosed, stop means are provided of which two embodiments are illustrated in the depicted example and which may be present alone or together, as illustrated. On one hand, the stop means may be formed by the front ends 23, 24 of the thread sections, which abut to each other in the closed position. On the other hand, the stop means may also be formed by at least one stop nose 9 formed on the edge of sleeve-shaped portion 5 which in the closed position abuts to a surface 10 of spout 2. In addition, stop noses 9 may limit the axial path covered while cap 3 is fitted for the first time by their abutment to a flange-like enlargement 21 of support member 20 on spout 2. Moreover, if provided in pairs, the abutment of stop noses 9 to enlargements 21 may stabilise the cap against tilting.

Due to the described seal on the inner wall of sleeve-shaped portion 5 and on the outer wall of tubular appendage 4, respectively, and due to the fact that the closed position is defined by stop means 9, 10 respectively 23, 24, the described container closure 1 opposes no initial resistance to being unscrewed as would be the case with a screw or bayonet closure where the seal is achieved on an annular front surface of a tubular part. However, such an initial resistance is desired, particularly because it prevents an involuntary opening of the container closure. Therefore, in the depicted exemplary embodiment according to FIG. 3, at least one so-called starting resistance nose is arranged at the lower annular edge of cap 3 which in the closed position abuts to an edge that delimits a surface 26 on spout 2 and thus causes the desired initial resistance. When this initial resistance is overcome, starting resistance nose 22 slides over surface 26 and the resistance it causes, which is opposed to the opening movement, decreases and finally ceases entirely when starting resistance nose 22 has left surface 26 on the other side.

According to a particular embodiment, container closure 1 is designed as a tamper-evident seal. To this end, recesses 29 are formed in wings 6 of cap 3 in which locking members 11 are fastened which together with a surface 12 provided on spout 2 form further stop means and oppose the first-time opening of container closure 1. As shown in FIG. 1, locking members 11 are connected to wings 6 by connecting portions 17 and by predetermined breaking points 18 arranged at a distance from connecting portions 17. When the aforementioned resistance is overcome on first-time opening, predetermined breaking point 18 will break and as a result, locking member 11 will swivel about a swivel axis formed by connecting portions 17 to reach the position shown in FIG. 5. In this manner it is possible that lower edge 28 of locking member 11 moves over surface 26 of spout 2 and container closure 1 can thus be opened. A locking nose 25 formed on locking member 11 prevents that locking member 11 returns to its original position in that this locking nose 25 abuts to the upper edge of recess 29. In this manner it is achieved on one hand that it is apparent at all times by the optically recognizable inclined position of locking member 11 that the container closure has been opened, and on the other hand, that locking member 11 abuts to surface 10 when the cap is reclosed and the inclined position can no longer be attained. In contrast to the depicted example, the connecting portions 17, the predetermined breaking point 18, and the locking nose 25 may be arranged in different locations within recess 29 as long as the described functions are maintained. If the connecting portions that form a swivel axis are arranged at the top of recess 29, locking nose 25 may be omitted since in this case the locking member is movable in an oscillating manner after the rupture of the predetermined breaking point and will not prevent reclosing.

LIST OF REFERENCE NUMERALS 1 container closure
2 spout
3 cap
4 tubular appendage
5 sleeve-shaped portion
6 wing
7 engagement means
8 engagement means
9 stop means
10 stop means
11 locking member
12 further stop means
13 circumferential rib
14 connecting region
15 neck
16 slot
17 connecting portion
18 predetermined breaking point
19 fin
20 support member
21 flange-like enlargement
22 starting resistance nose

23 front surface
24 front surface
25 locking nose
26 surface
27 centre axis
28 lower edge
29 recess
30 sealing neck

What is claimed is:

1. Container closure for flexible containers, comprising a spout configured to be connected to a container and having a tubular appendage and a cap that closes the spout, the cap having a sleeve-shaped portion that fits over the tubular appendage and having two wings that project therefrom radially or tangentially and whose respective planes extend substantially parallelly to the axis of the sleeve-shaped portion, the cap being movable, by a twisting movement of the cap relative to the spout, from a closed position in which it is retained on the spout by engagements arranged on an inner wall of the sleeve-shaped portion and on an outer wall of the appendage, to a released position in which it is separable from the spout in the direction of the aforementioned axis, wherein the engagements are designed and arranged in such a manner that the aforementioned twisting movement is less than 180 degrees, and cooperating stops are provided on the spout and on the cap which prevent a twisting movement of the cap relative to the spout beyond the closed position; and wherein in at least one of the wings, at least one locking member is arranged which by a predetermined breaking point is maintained in a position relative to the wing, which, together with a further stop provided on the spout, prevents an involuntary twisting movement of the cap relative to the spout in the direction towards the released position.

2. Container closure according to claim 1, wherein the sleeve-shaped portion of the cap has a seal which in the closed position sealingly lies against the inner wall and/or the outer wall of the tubular appendage in the area of a free end of the tubular appendage.

3. Container closure according to claim 1, wherein the engagements have thread sections.

4. Container closure according to claim 1, wherein the engagements provide a bayonet coupling.

5. Container closure according to claim 1, wherein a starting resistance nose is provided which opposes a twisting movement from the closed position towards the released position.

6. Container closure according to claim 1, wherein the locking member is connected to the wing by a hinge and is configured for being brought, after a rupture of the predetermined breaking point, from an initial position to a swivelled position in which a twisting movement of the cap relative to the spout in the direction towards the released position is possible.

7. Container closure according to claim 6, wherein a locking nose is arranged on the locking member which prevents that the locking member may return from its swivelled position to its initial position.

* * * * *